US005299908A

United States Patent [19]

Robbie

[11] Patent Number: 5,299,908

[45] Date of Patent: Apr. 5, 1994

[54] REGENERATIVE PUMP HAVING ROTOR WITH BLADES WHOSE INCLINATION VARIES RADIALLY OF THE ROTOR

[75] Inventor: Mark J. Robbie, Stirling, Great Britain

[73] Assignee: Dowty Defence and Air Systems Limited, Gloucestershire, United Kingdom

[21] Appl. No.: 917,053

[22] PCT Filed: Dec. 16, 1991

[86] PCT No.: PCT/GB91/02242

§ 371 Date: Sep. 9, 1992

§ 102(e) Date: Sep. 9, 1992

[87] PCT Pub. No.: WO92/10680

PCT Pub. Date: Jun. 25, 1992

[30] Foreign Application Priority Data

Dec. 15, 1990 [GB] United Kingdom ..... 9027230.3

[51] Int. Cl.[5] ..... F04D 5/00; F04D 29/18

[52] U.S. Cl. ..... 415/55.1; 415/55.2

[58] Field of Search ..... 415/55.1, 55.2, 55.3

[56] References Cited

U.S. PATENT DOCUMENTS

| | | | |
|---|---|---|---|
| 1,689,579 | 10/1928 | Burks . | |
| 4,804,313 | 2/1989 | Nasvytis | 415/55.1 |
| 5,123,809 | 6/1992 | Ito | 415/55.1 |

FOREIGN PATENT DOCUMENTS

| | | | |
|---|---|---|---|
| 758941 | 1/1934 | France . | |
| 5594 | 1/1982 | Japan | 415/55.1 |
| 86596 | 5/1982 | Japan | 415/55.1 |
| 97097 | 6/1982 | Japan | 415/55.1 |
| 481663 | 3/1938 | United Kingdom . | |
| 691513 | 5/1953 | United Kingdom | 415/55.1 |
| 944156 | 12/1963 | United Kingdom . | |
| 1585946 | 3/1981 | United Kingdom . | |

*Primary Examiner*—Edward K. Look
*Assistant Examiner*—Michael S. Lee
*Attorney, Agent, or Firm*—Young & Thompson

[57] ABSTRACT

A regenerative pump comprises a housing (1) with a pump inlet (13) and outlet (14), an impeller (5) with a plurality of blades (8) forming a series of cells (9) around the axis of rotation of the impeller, and a flow channel within the housing extending between the pump inlet and outlet and including a guide channel (15) in the housing into which the cells (9) open laterally of the impeller so as to induce a flow of fluid through the flow channel as the impeller is rotated. Each blade (8) extends radially over a first radial portion (20) thereof adjacent to the pump inlet (13) and over a second radial portion thereof adjacent to the guide channel (15) and has a trailing surface (19) with a profile that varies radially. The trailing surface of the blade over the first radial portion (20) is inclined forwardly in the direction of rotation (R) towards its outer edge (17) as compared with the trailing surface (19) of the blade over the second radial portion.

10 Claims, 5 Drawing Sheets

FIG. 1.
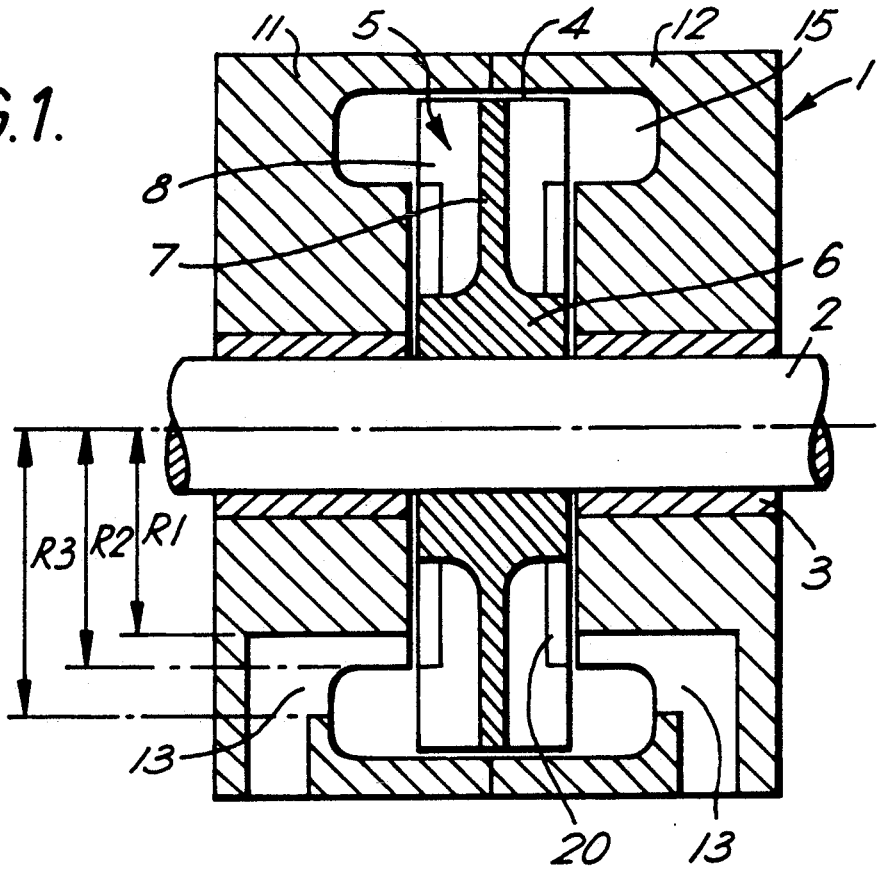
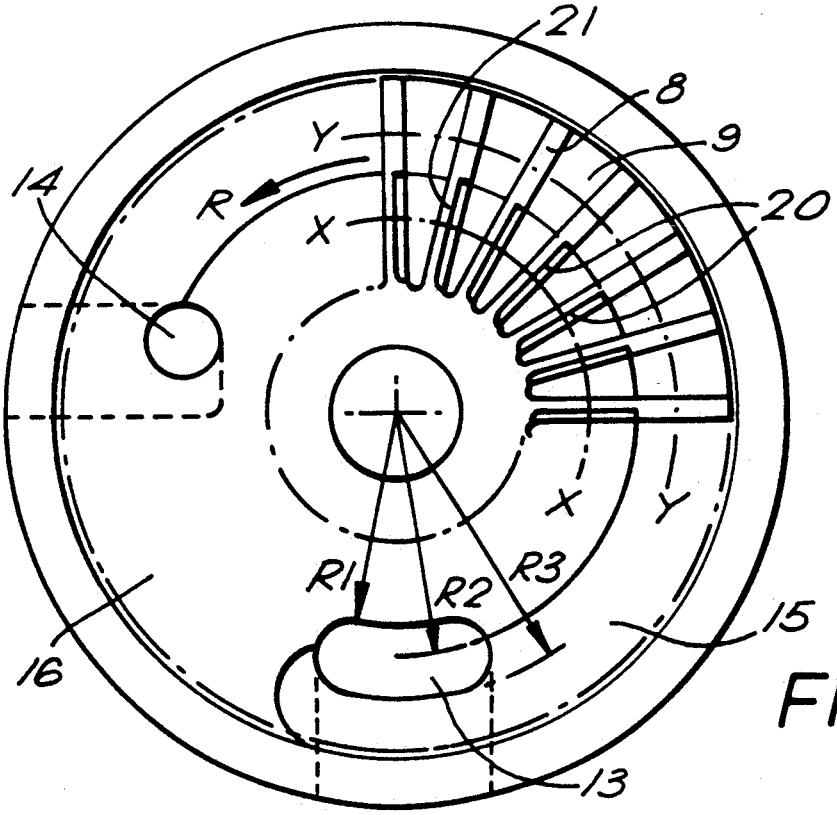
FIG. 2.

200
180
160
140
120
100
80
60
40
20
0
ΔP (PSI)
0
1
2
3
4
5
6
7
8
9
10
NPSP(PSI)
A
B
C
D

REGENERATIVE PUMP HAVING ROTOR WITH BLADES WHOSE INCLINATION VARIES RADIALLY OF THE ROTOR

TECHNICAL FIELD

This invention relates to a regenerative pump of the kind comprising a housing with a pump inlet and a pump outlet, an impeller rotatably mounted within the housing and having a plurality of blades forming a series of cells spaced angularly around the axis of rotation of the impeller, and a flow channel within the housing extending between the pump inlet and pump outlet and including a guide channel in the housing located alongside the impeller so that the cells open laterally of the plane of rotation of the impeller into said guide channel and cooperate therewith to induce a spiral or helical flow of fluid through the guide channel and cells along the length of said flow channel as the impeller is rotated.

In the known regenerative pumps of this kind, the blades of the impeller may extend perpendicular to the plane of rotation of the impeller or may be inclined from this perpendicular plane forwards in the direction of rotation at their outer edge so that the cells fill more efficiently and throw the fluid forwards into the guide channel as the impeller rotates. Typically, the blades are inclined at an angle of approximately 45 degrees and the opposite surfaces of each blade are flat and parallel to one another and at their outer edges meet a flat outer surface of the blade parallel to the plane of rotation of the impeller which closely cooperates with the inner surfaces of the housing to limit the circumferential flow of fluid between adjacent cells, especially in the region known as the stripper between the pump outlet and pump inlet. In all cases, the blades are of a substantially uniform cross-section throughout their radial length; in particular those sections adjacent to the pump inlet and guide channel have the same cross-section.

DISCLOSURE OF THE INVENTION

An object of the present invention is to provide a regenerative pump of the aforesaid kind with improved performance.

According to the present invention, a regenerative pump of the aforesaid kind has blades which are adapted so that the profile of the trailing surface of each blade varies radially, the trailing surface of the blade over a first radial portion adjacent to the pump inlet being inclined forwardly in the direction of rotation towards its outer edge as compared with the trailing surface of the blade over a second radial portion adjacent to the guide channel.

The inclination of the trailing surfaces of the blades of the impeller over said first radial portion adjacent to the pump inlet is selected so as to reduce unstable flow conditions and cavitation affects in this region and thereby reduce secondary motion in the radially outward flow in the cells. The recirculating flow in the guide channel is therefore enhanced and the head pressure generated by the pump increased. Further, flow losses in the pump are reduced and pump efficiency increased. These improvements are especially significant under low inlet pressure conditions and help to delay the onset of vapour formation in the pump that would block the through flow.

The inclination of the trailing surface of the blade over said second radial portion adjacent to the guide channel is selected to match the flow between the cells and the guide channel as the fluid recirculates between the two. This involves a difference in inclination of the trailing surfaces of said first and second radial portions, the trailing surface of the first radial portion being relatively inclined forwards in the direction of rotation towards its outer edge.

In one embodiment of the invention, the relative forward inclination of the trailing surface over said first radial portion of the blade is produced by a chamfer that extends across the rear outer portion of the blade. The leading and trailing surfaces of each blade may be substantially parallel except for this chamfer on the trailing edge over said first radial portion.

Preferably, the outer edge of each blade has a flat surface parallel to the plane of rotation of the impeller so as to cooperate with adjacent portions of the inner surface of the housing and limit the undesired circumferential flow of fluid therebetween. For example, it is necessary for the blades to cooperate with the stripper between the pump outlet and pump inlet to limit the direct flow of fluid therebetween. Also, if the pump inlet and guide channel are spaced radially apart, that portion of the blades between the pump inlet and guide channel preferably have a flat outer surface that is wide enough to restrict return flow from the guide channel to the pump inlet.

In said embodiment of the invention in which the trailing surfaces of the blades are chamfered to produce said relative forward inclination, the chamfer is preferably such as to retain a flat surface on the outer edge of the blade, although this may be narrower than other portions of the flat outer surface along the whole radial edge of the blade.

DESCRIPTION OF THE DRAWINGS

The invention will now be described by way of example with reference to the accompanying drawings in which:

FIG. 1 is a section through a regenerative pump according to one embodiment of the invention, FIG. 2 is a side elevation of the regenerative pump of FIG. 1.

MODE OF CARRYING OUT THE INVENTION

Figure 3:
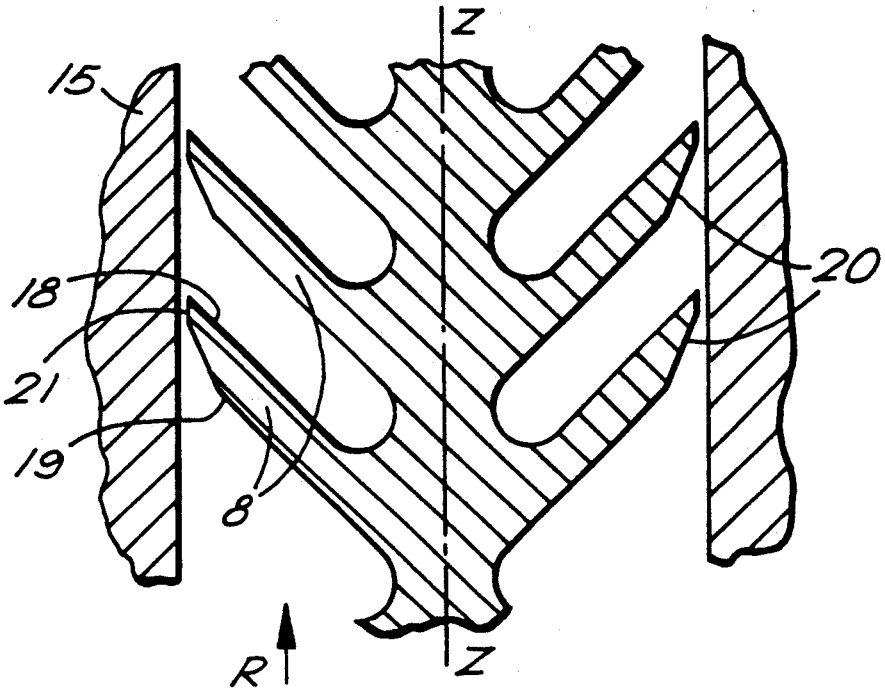
FIG. 3 is a section of part of the impeller of the pump along the line X—X in FIG. 2.

The regenerative pump illustrated in FIGS. 1 to 4 comprises a housing 1 that rotatably supports a shaft 2 in bearings 3 and defines a cylindrical chamber 4 that receives an impeller 5 mounted on the shaft 2. The impeller 5 comprises a hub 6 and a ring 7 that extends radially outwards from the hub 6 and carries a set of blades 8 on both sides that extend laterally and radially of the ring 7. The blades 8 are formed integrally with the hub 6 and ring 7 and conform to a cylindrical profile at their outer periphery to be received as a close fit within the chamber 4.

Figure 4:
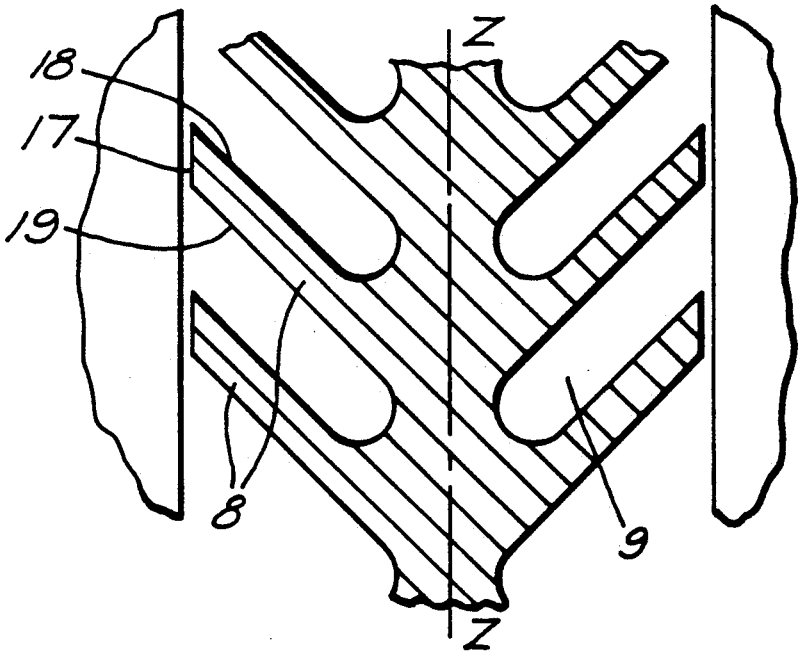
FIG. 4 is a section of part of the impeller of the pump along the line Y—Y in FIG. 2.

The blades 8 on each side of the ring 7 extend away from the ring in the direction of rotation R of the impeller at an angle of approximately 45 degrees to the central plane of rotation Z—Z of the ring as shown in FIGS. 3 and 4. The spaces 9 between the blades 8 define a ring of cells each side of the impeller.

The housing 1 is formed in two sections 11, 12 that meet on the central plane of the impeller 5. A pump inlet 13 is formed in the side wall of each section 11, 12 and opens into the chamber 4 opposite one another and adjacent to the middle region of the cells 9. A pump outlet 14 is formed in the side wall of each section 11, 12 of the housing and opens into the chamber 4 opposite one another and adjacent to the middle region of the cells 9 but in a location which is offset angularly in the direction of rotation R of the impeller by approximately 225 degrees from the pump inlets 13, as shown in FIG. 2.

A guide channel 15 is formed in the side wall of each section 11, 12 of the housing so as to open into the chamber 4. This channel 15 extends alongside the outer portion of the impeller over an angle of approximately 315 degrees between the pump inlet 13 and the pump outlet 14. The uninterrupted portion 16 of the side wall of the housing between the closed ends of the guide channel acts as a stripper which limits the direct flow of fluid from the pump outlet 14 to the pump inlet 13 as will become apparent in the following description of the operation of the pump.

In operation, the impeller 5 rotates in the direction R and serves to produce a radially outward flow of fluid in the cells 9 through centrifugal action. At the outer periphery of the rotor, the fluid is directed laterally outwards into the guide channels 15 where it is recirculated inwards back into the cells 9. This recirculating action continues along the whole length of each guide channel 15 as the impeller rotates, thereby increasing the pressure of the fluid until it is discharged through the pump outlet 14. It will be appreciated that fluid is carried in the cells 9 across the stripper 16 between the closed ends of the guide channel 15, but the close proximity of the outer edges 17 of the blades 8 to the inner surface of the stripper limits the flow of fluid directly therebetween from the pump outlet 14 back to the pump inlet 13.

It is known in a pump as described so far, to provide an impeller in which the blades 8 have a uniform cross-section, as shown in FIG. 4, throughout their radial length, with the leading surface 18 of each blade substantially parallel to the trailing surface 19 of each blade. However, the pump according to the invention is adapted so that the trailing surface 19 of each blade in that region that passes adjacent to the pump inlet 13 is adapted so that it is inclined forwards in the direction of rotation towards its outer edge. Thus, as shown in FIG. 2, that portion of each blade 8 between an impeller radius R1 corresponding to the inner edge of the pump inlet 13 and an impeller radius R2 corresponding to the inner edge of the guide channel 15, has its trailing surface 19 inclined forwards towards its outer edge, as shown in FIG. 3, compared with the trailing surface 19 along the rest of the blade as shown in FIG. 4.

Said inclination is simply provided by forming a chamfer 20 on the trailing surface 19 over its outer portion, leaving a flat portion 21 on the outer edge of the blade preferably over at least one third of the full unchamfered width of the outer edge, as shown in FIG. 4. Typically, the chamfer is formed at an angle of approximately 22½ degrees to the unchamfered trailing surface 19.

Figure 7:
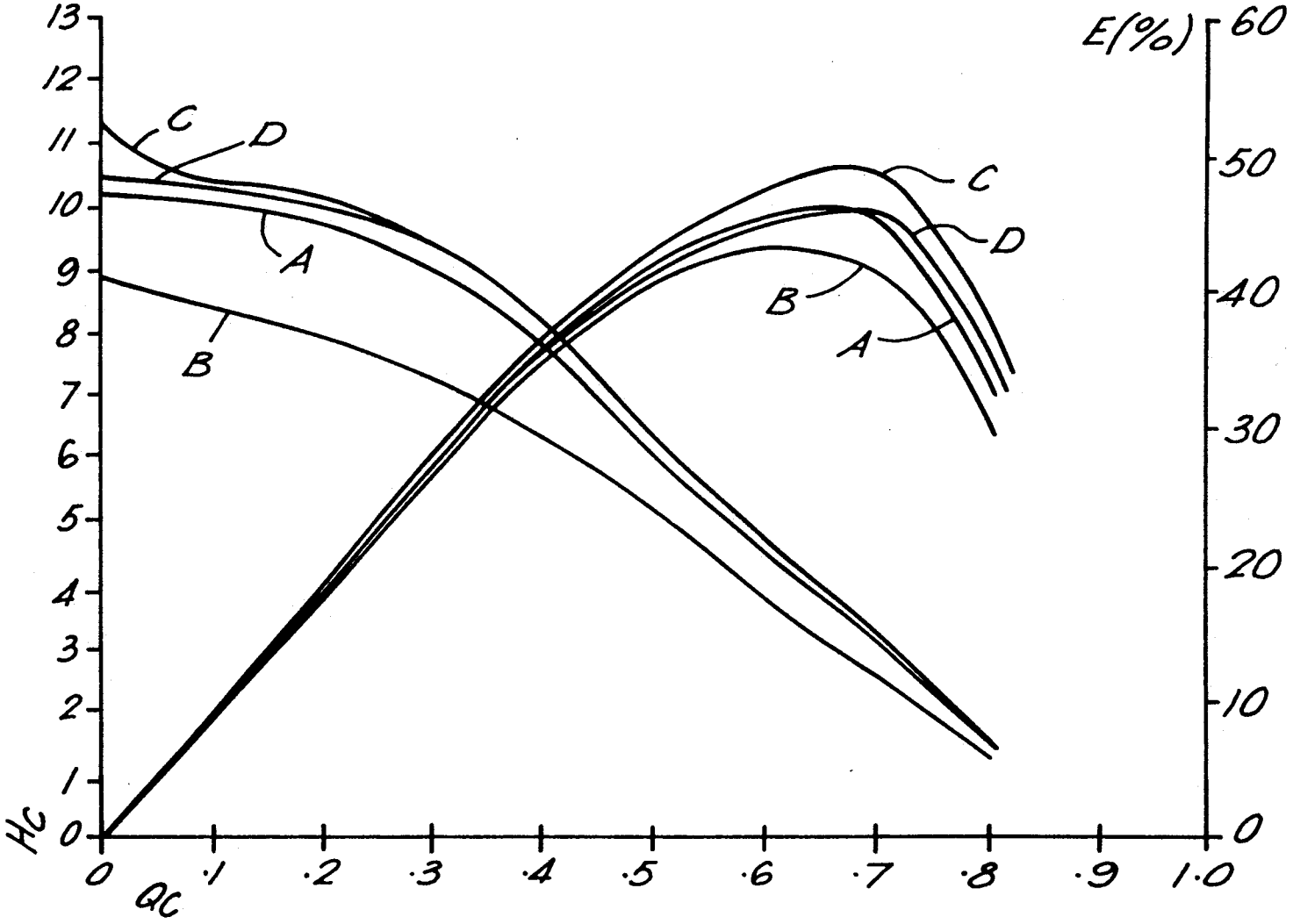
FIG. 7 is a graph showing the head coefficient ($H_c$) against flow coefficient ($Q_c$) of the pump of FIG. 1.
Figure 8:
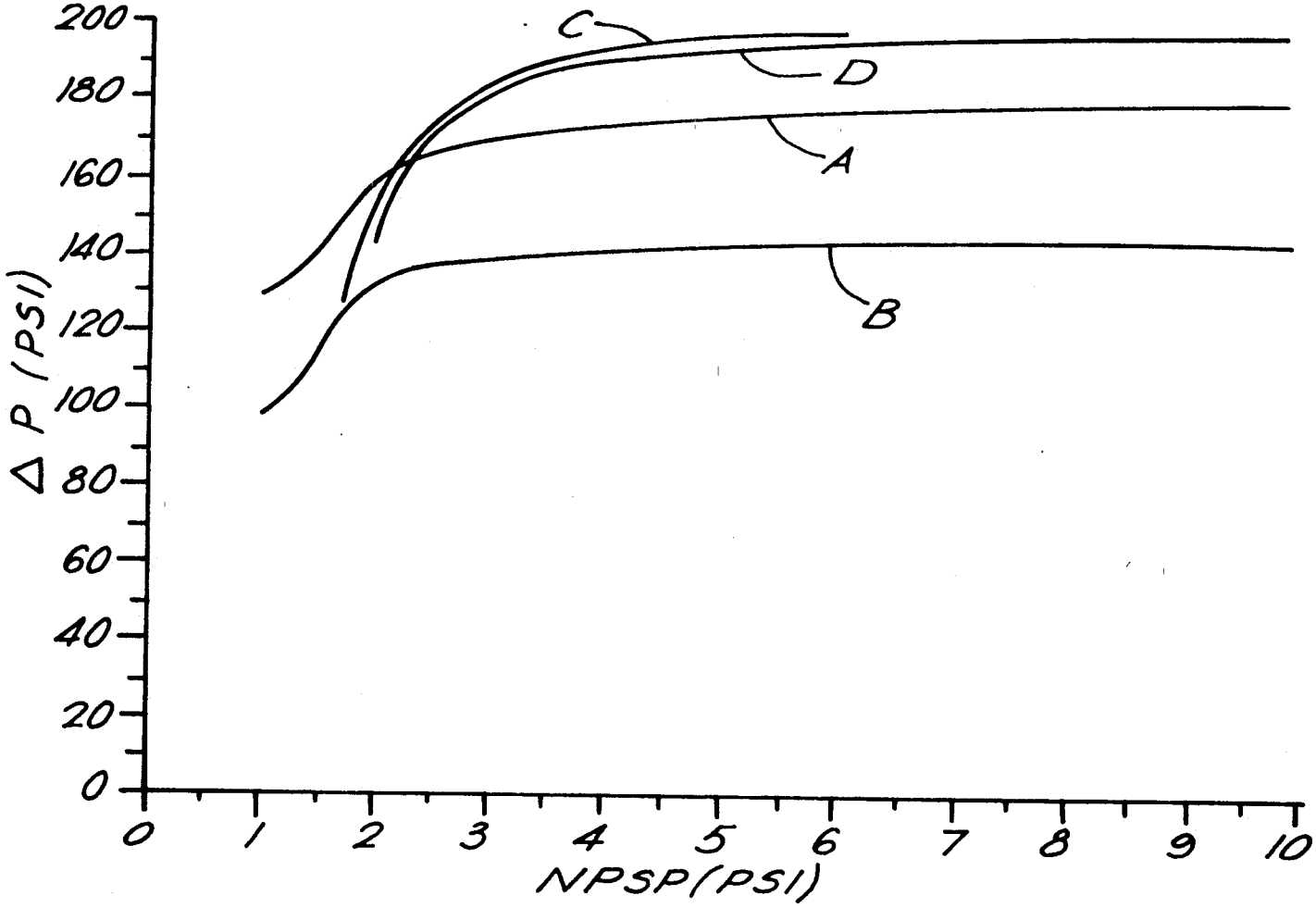
FIG. 8 is a graph showing the net positive suction pressure (NPSP) against pressure difference across the pump ($\Delta P$) for the pump of FIG. 1.

The effect of this modification to the profile of the trailing edge 19 of each blade 8 is demonstrated in FIGS. 7 and 8.

FIG. 7 shows the results of tests to determine the head pressure coefficient $H_c$ and efficiency E of the pump against the flow coefficient $Q_c$ of the pump. The tests were carried out at an impeller speed of 8000 r.p.m. and a pump inlet pressure of 20 p.s.i. The results are shown by curves A in FIG. 7, and are compared with curves B based on the results of similar tests on the same pump but with an impeller having blades of a uniform cross-section (shown in FIG. 4) throughout their length. It is clear from these curves that the effect of the chamfer 20 on the trailing surfaces of the blades is to increase the head pressure generated and efficiency of the pump over the whole of the operating range.

FIG. 8 shows the results of a test to determine the pressure difference ΔP produced across the pump at lower values of net positive suction pressure NPSP. Again the results of the pump, shown by curve A, are compared with the results, shown by curve B, for the same pump but with an impeller having blades of a uniform cross-section (shown in FIG. 4) throughout their length. It is clear from these curves that ΔP falls off less rapidly as a result of the chamfer 20 on the trailing surfaces of the blades.

These improvements in performance can be further illustrated by comparison with similar tests on the same pump but with an impeller in which the chamfer 20 is extended radially outwards beyond the inner edge of the guide channel 15 at radius R2. In one case, the chamfer 20 was extended out to the outer edge of the pump inlet 13 at radius R3 and the results shown by curves C in FIGS. 7 and 8 were obtained, and in another case, the chamfer 20 was extended out the full radial extent of the blades and the results shown by curves D in FIGS. 7 and 8 were obtained. The results in FIG. 7 confirm that the chamfer 20 gives improved head pressure $H_c$ and efficiency E, but FIG. 8 demonstrates that the chamfer 20 can have an adverse affect on the performance of the pump at lower values of net positive suction pressure NPSP if it extends into the region adjacent to the guide channel 15. In both cases with a radially extended chamfer, the rate of decrease of ΔP below 4 p.s.i. increases rapidly leading to early vapour lock in the pump as compared with the pump having the partly chamfered impeller illustrated.

The regenerative pump as illustrated in FIGS. 1 to 4 has the pump inlets 13 and pump outlets 14 both located on a radius of the guide channel 15. The two sets of cells 9 on opposite sides of the impeller each have a separate pump inlet 13 and pump outlet 14 which are connected in parallel by external connections.

Figure 5:
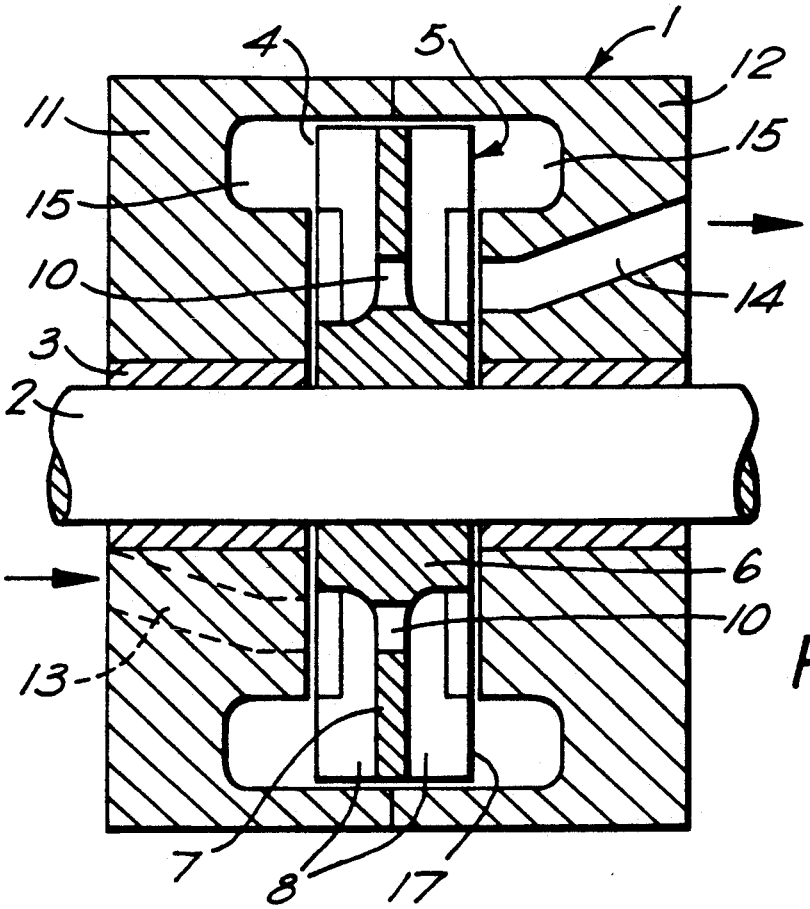
FIG. 5 is a section through a regenerative pump similar to that of FIG. 1 but with a different arrangement of pump inlet and pump outlet.
Figure 6:
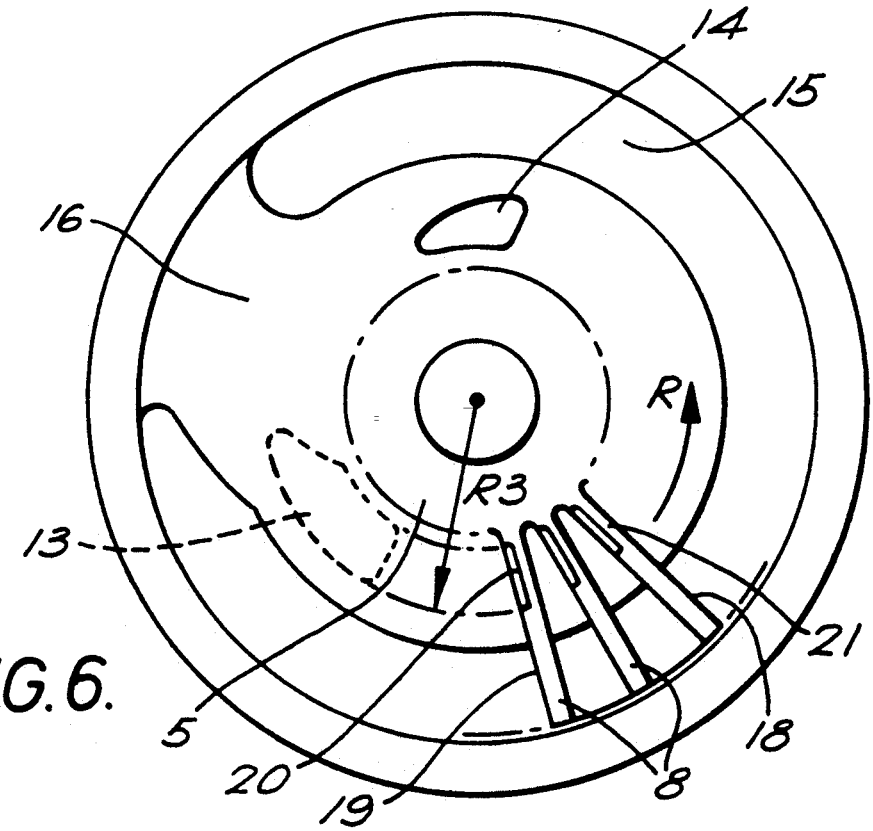
FIG. 6 is a side elevation of the pump of FIG. 5.

An alternative embodiment of the invention is illustrated in FIGS. 5 and 6 in which the two sets of cells 9 on opposite sides of the impeller are connected by holes 10 through the ring 7 at the root of the blades 8. Because the cells 9 are interconnected, there is just one pump inlet 13 in the side wall of one housing section 11 on one side of the impeller, and one pump outlet 14 in the side wall of the other housing section 12 on the other side of the impeller. Further, the pump inlet 13 and pump outlet 14 are both set radially inwardly away from the guide channel 15. For this reason, the pump retains a ring of liquid at the outer periphery of the impeller which helps maintain a pumping action when the fluid pumped is in a mixed phase of gas and liquid. The pump is therefore self-priming.

The trailing surface 19 of each blade 8 of the impeller 5 is formed with a chamfer 20 of the same cross-section as shown in FIG. 3, and this extends radially to the outer edge of the pump inlet 13 at radius R3, as shown in FIG. 6. The radial separation of the pump inlet 13 and the guide channel 15 allows the chamfer 20 to extend the whole way across the pump inlet 13 without overlapping the guide channel 15 as in the embodiment of FIGS. 1 and 2.

In alternative embodiments of the invention, the flat chamfer 20 on the trailing surface 19 of the blades 8 may be replaced by a curved surface, but preferably, the flat portion 21 at the outer edge of the blade is retained. In other alternative embodiments, the forwards inclination of the trailing surface 19 may be achieved by twisting the respective portion of the blade forwards towards its outer edge.

I claim:

1. A regenerative pump comprising a housing with a pump inlet and a pump outlet, an impeller rotatably mounted within the housing and having a plurality of blades forming a series of cells spaced angularly around the axis of rotation of the impeller, and a flow channel within the housing extending between the pump inlet and pump outlet and including a guide channel in the housing located alongside the impeller so that the cells open laterally of the plane of rotation of the impeller into said guide channel and cooperate therewith to induce a spiral or helical flow of fluid through the guide channel and cells along the length of said flow channel as the impeller is rotated, each blade (8) extending radially over a first radial portion (20) thereof adjacent to at least a part of the pump inlet (13), and over a second radial portion thereof adjacent to at least a part of the guide channel (15) spaced radially from the pump inlet, and having a trailing surface (19) with a profile that varies radially, the trailing surface of the blade over said first radial portion (20) being inclined forwardly in the direction of rotation (R) towards its outer edge (17) as compared with the trailing surface (19) of the blade over said second radial portion.

2. A regenerative pump as claimed in claim 1 in which the pump inlet (13) and guide channel (15) overlap radially and said first radial portion (20) is that portion adjacent to the pump inlet (13) spaced radially from the guide channel (15).

3. A regenerative pump as claimed in claim 1 in which the pump inlet (13) and guide channel (15) are spaced apart radially and said first radial portion (20) is that portion adjacent to the pump inlet (13) and which terminates short of the guide channel (15).

4. A regenerative pump as claimed in claim 1 in which the pump inlet (13) and pump outlet (14) are spaced radially inwardly of the guide channel (15).

5. A regenerative pump as claimed in claim 1 in which the relative forward inclination of the trailing surface (19) over said first radial portion of the blade (8) is produced by a chamfer (20) that extends across the rear outer portion of the blade.

6. A regenerative pump as claimed in claim 5 in which the leading surface (18) of each blade (8) is substantially parallel to the trailing surface remote from said chamfer (20).

7. A regenerative pump as claimed in claim 1 in which the outer edge (17) of each blade (8) has a flat surface parallel to the plane of rotation of the impeller over substantially the whole of the radial length of the blade so as to cooperate with adjacent portions of the inner surface of the housing (1) and limit the circumferential flow of fluid therebetween.

8. A regenerative pump as claimed in claim 7 in which the flat surface of the outer edge (17) of the blade adjacent to said first radial portion (20) is narrower than the flat surface of the outer edge (17) of the blade adjacent to said second radial portion.

9. A regenerative pump as claimed in claim 1 in which said blades (8) are inclined forwardly in the direction of rotation (R) of the impeller (5) towards their outer edges (17).

10. A regenerative pump comprising a housing with a pump inlet and a pump outlet, an impeller rotatably mounted within the housing and having a plurality of blades forming a series of cells spaced angularly around the axis of rotation of the impeller, and a flow channel within the housing extending between the pump inlet and pump outlet and including a guide channel in the housing located alongside the impeller so that the cells open laterally of the plane of rotation of the impeller into said guide channel and cooperate therewith to induce a spiral or helical flow of fluid through the guide channel and cells along the length of said flow channel as the impeller is rotated, the guide channel being spaced radially from the pump inlet, and each blade (8) extending radially over a first radial portion (20) thereof adjacent to the pump inlet (13), and over a second radial portion thereof adjacent to the guide channel (15) and having a trailing surface (19) with a profile that varies radially, the trailing surface of the blade over said first radial portion (20) being inclined forwardly in the direction of rotation (R) towards its outer edge (17) as compared with the trailing surface (19) of the blade over said second radial portion.

* * * * *